US008960822B1

(12) United States Patent
Hsu

(10) Patent No.: US 8,960,822 B1
(45) Date of Patent: Feb. 24, 2015

(54) DRAWER TRACK WITH ANTI-SLIP STRUCTURE

(71) Applicant: Yen-Huang Hsu, Changhua (TW)

(72) Inventor: Yen-Huang Hsu, Changhua (TW)

( * ) Notice: Subject to any disclaimer, the term of this patent is extended or adjusted under 35 U.S.C. 154(b) by 0 days.

(21) Appl. No.: 14/097,536

(22) Filed: Dec. 5, 2013

(51) Int. Cl.

| | |
|---|---|
| ***A47B 88/00*** | (2006.01) |
| ***A47B 88/16*** | (2006.01) |
| ***A47B 88/04*** | (2006.01) |
| ***A47B 96/00*** | (2006.01) |

(52) U.S. Cl.
CPC ..... *A47B 88/16* (2013.01); *A47B 88/04* (2013.01); *A47B 96/00* (2013.01)
USPC ..... 312/334.4; 312/351

(58) Field of Classification Search
CPC ..... A47B 88/16; A47B 88/04; A47B 96/00; A47B 2210/0059; A47B 2210/0056
USPC ..... 108/147.11–147.18, 109; 211/187, 190, 211/126.15, 134, 186, 188; 312/334.44, 312/334.45–334.47, 332, 334.1, 334.7, 312/348.1, 334.27, 334.8, 334.4, 349, 351
See application file for complete search history.

(56) References Cited

U.S. PATENT DOCUMENTS

| | | | | |
|---|---|---|---|---|
| 3,677,615 | A * | 7/1972 | Hudson | 384/20 |
| 3,733,113 | A * | 5/1973 | Glassford et al. | 312/348.1 |
| 4,453,790 | A * | 6/1984 | Cohen et al. | 312/334.7 |
| 4,620,637 | A * | 11/1986 | Karashima | 211/188 |
| 4,725,066 | A * | 2/1988 | Nootenboom et al. | 280/79.3 |
| 4,821,481 | A * | 4/1989 | Woodman | 52/664 |
| 5,065,873 | A * | 11/1991 | Tseng | 211/187 |
| RE34,171 | E * | 2/1993 | Romick et al. | 312/257.1 |
| 5,470,144 | A * | 11/1995 | Wen | 312/334.13 |
| 5,588,729 | A * | 12/1996 | Berger | 312/334.4 |
| 5,592,719 | A * | 1/1997 | Eto et al. | 24/453 |
| 6,044,988 | A * | 4/2000 | Yang | 211/187 |
| 6,142,596 | A * | 11/2000 | Carson | 312/334.39 |
| 6,250,730 | B1 * | 6/2001 | Roth et al. | 312/333 |
| 6,378,967 | B1 * | 4/2002 | Moser et al. | 312/334.1 |
| 6,431,090 | B1 * | 8/2002 | Davis et al. | 108/107 |
| 6,481,812 | B1 * | 11/2002 | Domenig et al. | 312/334.6 |
| 6,732,662 | B2 * | 5/2004 | Welch et al. | 108/109 |
| 7,568,436 | B2 * | 8/2009 | McAllister et al. | 108/147.12 |
| 7,963,408 | B2 * | 6/2011 | Glover | 211/126.15 |
| 8,353,489 | B2 * | 1/2013 | Phelan et al. | 248/127 |
| 2003/0131767 | A1 * | 7/2003 | Chen | 108/147.13 |
| 2008/0083685 | A1 * | 4/2008 | Chen | 211/134 |
| 2008/0246377 | A1 * | 10/2008 | Huang | 312/334.8 |

* cited by examiner

*Primary Examiner* — Daniel J Troy
*Assistant Examiner* — Hiwot Tefera
(74) *Attorney, Agent, or Firm* — Che-Yang Chen; Law Office of Michael Chen

(57) ABSTRACT

A drawer track with an anti-slip structure may include four connecting units; two rails horizontally installed on both sides of a receiving space formed by said connecting units at four corners, said rail having multiple through holes and a slide sheet on each inner portion of the rails; a drawer; and at least one anti-slip member. The drawer is placed onto and slides along the slide sheets of the rail. The rail has multiple through holes and is connected with the L-shaped anti-slip member to limit the movement of the drawer. The drawer track with an anti-slip structure can be quickly and conveniently installed and safely operated, and provide sufficient structural stability.

9 Claims, 10 Drawing Sheets

DRAWER TRACK WITH ANTI-SLIP STRUCTURE

FIELD OF INVENTION

The present invention relates to a drawer track structure, especially to a drawer track with anti-slip structure to restrict the drawer's movement.

BACKGROUND OF THE INVENTION

Simplified drawer track structures are commonly used in homes or offices for storing or organizing small items. The drawers that are placed onto the tracks help to store small items in an organized way and allow small items to be stored and found conveniently, thereby saving storage space and providing a tidy and neat living or working environment. A simplified conventional drawer track structure has two side support members with multiple layers of slide rails installed between the two side support members. The slide rails are commonly made of metal materials and have L-shaped cross-sections for increased structural support. In addition, the drawer of the conventional track has sliding boards that are horizontally extended outwardly from both sides of the drawer, and the drawer is placed onto and slides along the slide rails with the sliding boards. Since there is no position limiting unit present to restrict the excessive movement of the drawer, the drawer may slide out from the slide rails when the drawer is subjected to excessive movement or the drawer may fall from the drawer track structure when the track is impacted with external force, which is a deficiency of the conventional drawer track structure in practical uses. Furthermore, the shape of the drawer may be deformed if heavy items are stored, which causes the central part of the drawer to become depressed and the drawer to bend inwardly, thereby the distance between the two sliding boards of the drawer is reduced, and as a result the drawer is likely to drop from the track, which is another deficiency of the conventional drawer track structure in practical uses.

To solve the previously described problems of the conventional drawer track structure, the present invention provides a drawer track with an anti-slip structural design to overcome the problems presented above.

SUMMARY OF THE INVENTION

The present invention provides a novel and improved drawer track structure that solves the technical problems of the conventional drawer track structures.

The drawer track with an anti-slip structure of the present invention may include four connecting units, two rails, a drawer, and at least one anti-slip member. At least one pair of rails are horizontally installed on both sides of a receiving space formed by said connecting units at four corners The rail has a plurality of through holes and a slide sheet disposed an inner portion of the rail. The rails has at least one fixing member connected to one of its ends, which comprises a first block unit and a second block unit, wherein the first block unit is connected to the edge of the rail and the second block unit is connected to the first block unit. Each of the first block unit and the second block unit has a semicircular notch corresponding to each other. The first block unit and the second block unit are connected with a flexible unit, which allows the second block unit to flip over, and the first block unit and the second block unit engage with each other to enclose the connecting unit, and the connecting unit has a plurality of ring groove. The first block unit has a protruding wedge connector located at one side of the rail, and the second block unit has a round rod distant from the first block unit, wherein the round rod is engaged with the wedge connector to achieve a secured connection. Furthermore, semicircular notch of the first and the second block units each has a semicircular protruding ring bulged from the inner surface of the semicircular notches to plug into the ring groove of the connecting unit. A drawer has two top frames protruding from the top portion thereof, and the drawer is placed onto and slides along the slide sheets of the rails with the top frames. Furthermore, at least one L-shaped anti-slip member is installed to the rail, and the L-shaped anti-slip member comprises a body unit and a stopper plate, wherein the body unit has a plurality of cylindrical bodies to plug into the through holes of the rail. The cylindrical body has a conical head and multiple axial slots, so the conical head of the cylindrical body is able to be inserted into the through hole of the rail, and the conical head is configured to prevent the cylindrical body to detach from the through hole of the rail. The body unit extends to the drawer and allows the stopper plate of the anti-slip member to contact the inner side of the top frame of the drawer, thereby restricting the sliding movement of the drawer within a certain range and preventing the drawer to detach from the rail due to deformation caused by storing heavy items.

The first major advantage of the drawer track structure of the present invention is that its structural stability is greatly increased by the inclusion of a anti-slip member, which is connected to the rail by the cylindrical bodies of the body unit that are interposed into the through holes of the rail. The body unit of the anti-slip member extends towards the drawer, which allows the stopper plate to be placed against the inner wall of the drawer. During the sliding movement of the drawer, the stopper plate of the anti-slip member limits the maximum opening and closing positions therefore prevents the drawer to fall out of the track as a result of excessive sliding out movement. In addition, when heavy items are placed into the drawer, the middle portion of a drawer may become deformed and bend downwardly, which reduces the distance between the two side borders of the drawer thus causes the drawer to fall off the drawer track structure. The structural design of the novel drawer track structure of the present invention, by placing the stopper plate of the anti-slip member to contact against the inner wall of the drawer, prevents the drawer to detach from the slide sheet of the rail due to the deformation of the drawer, thereby increasing the structural stability of the drawer track structure in practical uses.

The second major advantage of the drawer track structure of the present invention is the application of the two semicircular notches of the first and the second bodies of the rail to enclose the connecting unit and secure the connection of the rail to the connecting unit. The semicircular rings present in the inner surface of the two notches are also interposed into the ring grooves located in the outer surface of the connecting unit, which further increases the strength of the connection. This structural design also allows the connection between the rail and the connecting unit to be quickly and conveniently assembled.

The third major advantage of the drawer track structure of the present invention is the inclusion of at least one conjugating unit connected to the connecting unit. The conjugating unit comprises a main conjugating unit with a hook, and an axillary conjugating unit connected to one side of the main conjugating unit. The main conjugating unit and the axillary conjugating unit are located on the opposite sides of the connecting unit and enclose the connecting unit. The main conjugating unit has a hook which allows articles to be hanged, thereby increasing the possible uses of the drawer track structure of the present invention.

Other advantages and structural characteristics of the drawer track structure of the present invention are further described in detail with the assistance of related drawings.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, the same or equivalent functions and components may be accomplished by different embodiments that are also intended to be encompassed within the spirit and scope of the invention.

Figure 1:
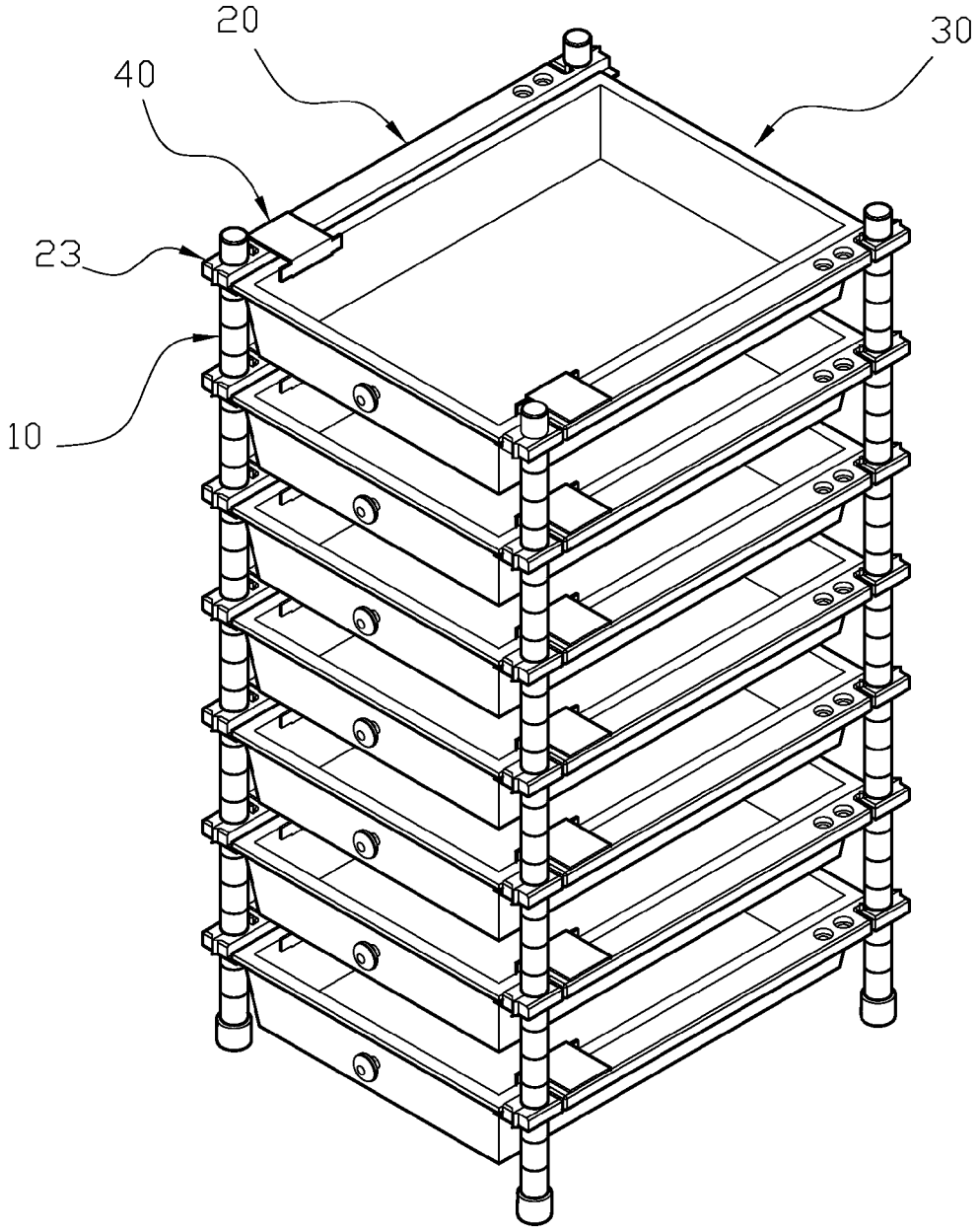
FIG. 1 is a perspective view of drawer track structure of the present invention.
Figure 2:
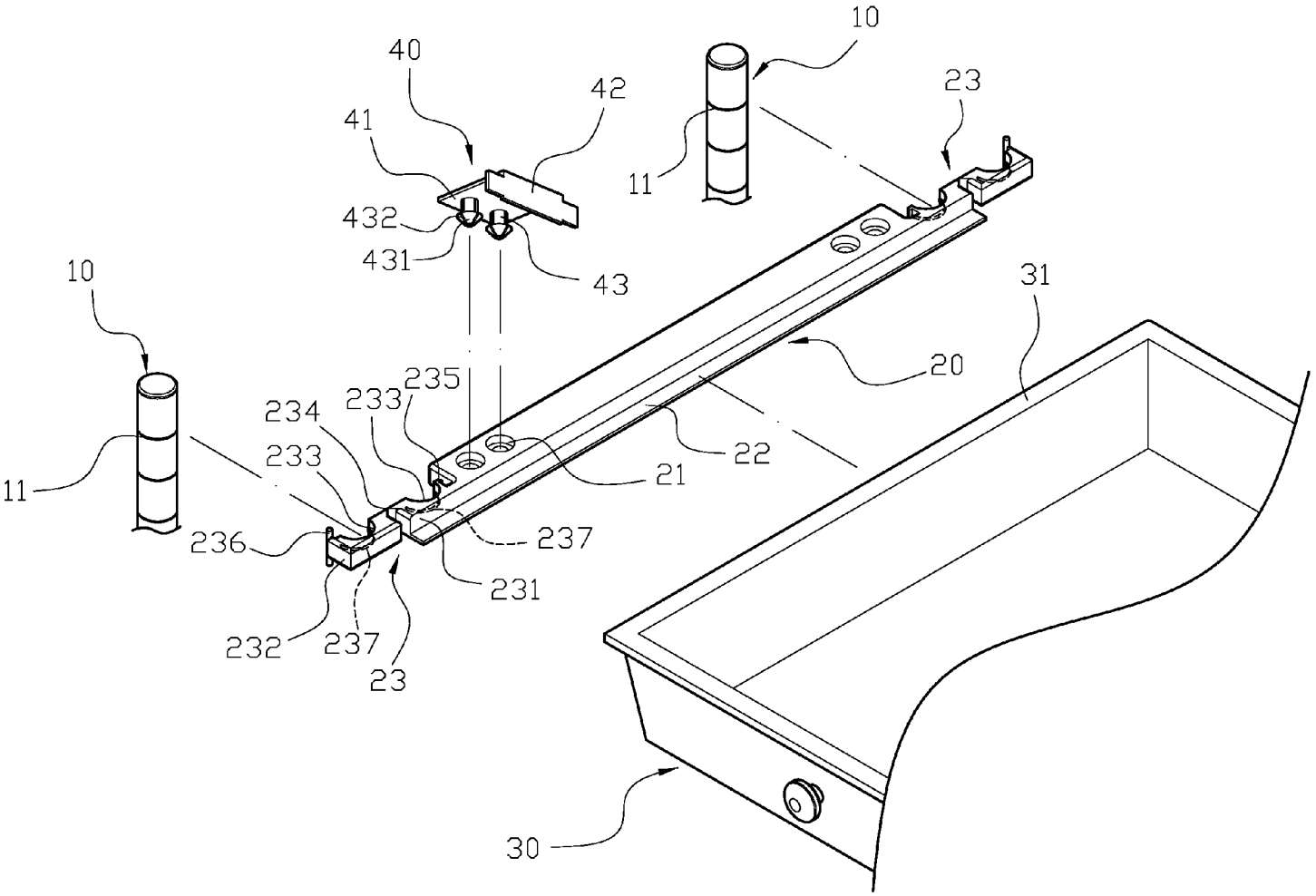
FIG. 2 is an exploded perspective view of drawer track structure of the present invention.
Figure 3:
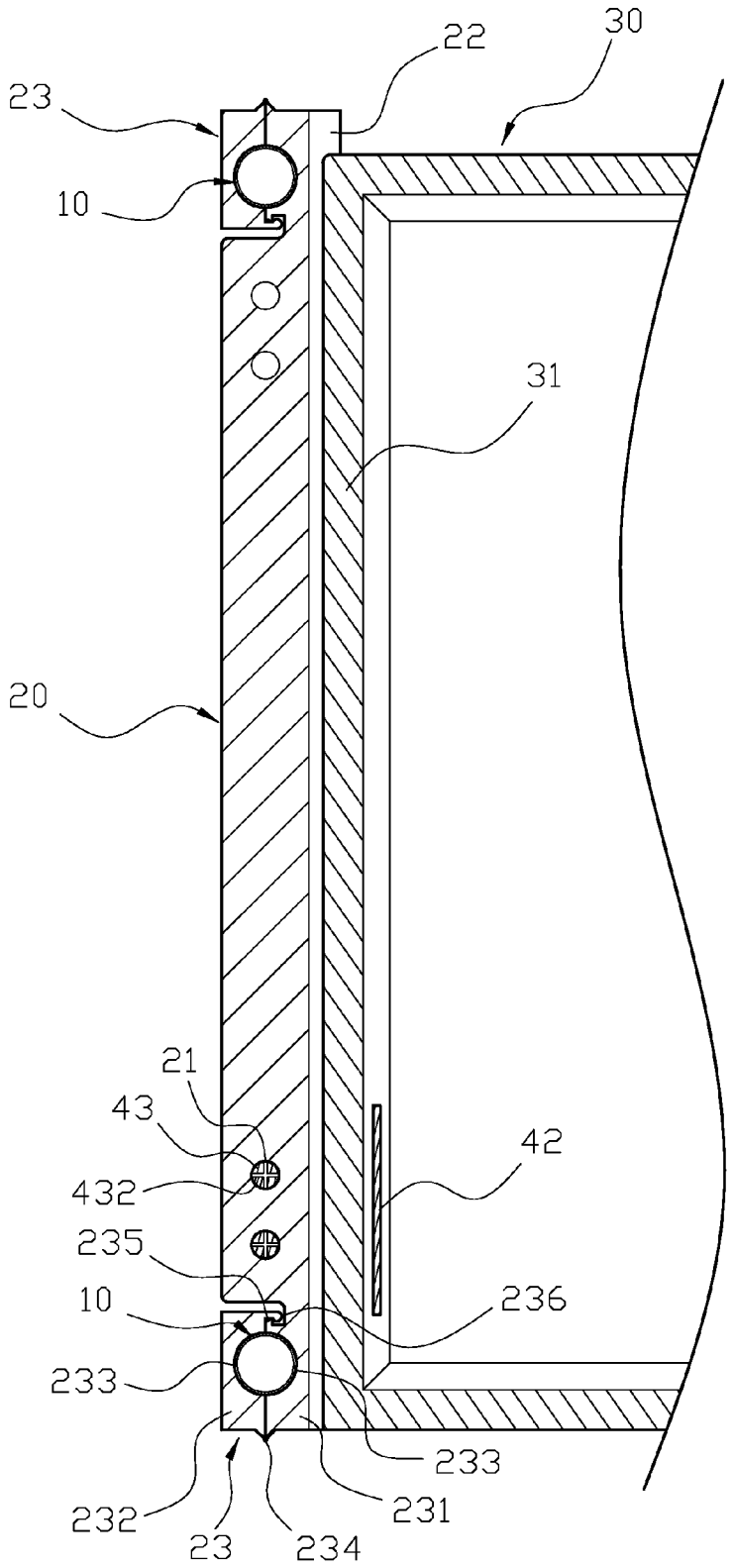
FIG. 3 is a horizontal sectional view of drawer track structure of the present invention.
Figure 5:
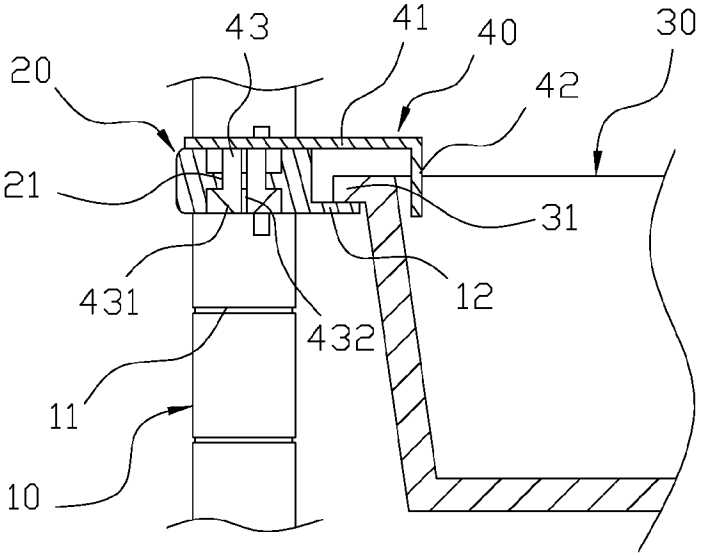
FIG. 5 is a vertical sectional view of the drawer track structure of the present invention.
Figure 4:
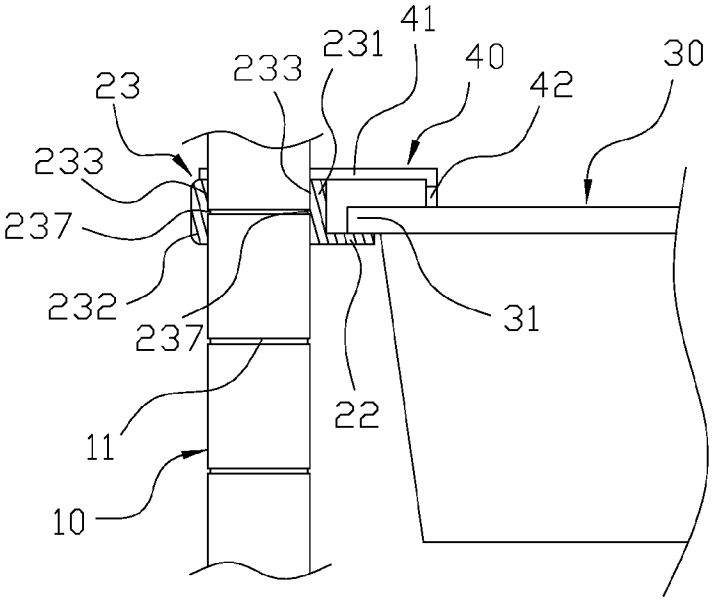
FIG. 4 is a sectional view of the fixing member of the rail of the drawer track structure of the present invention.
Figure 6:
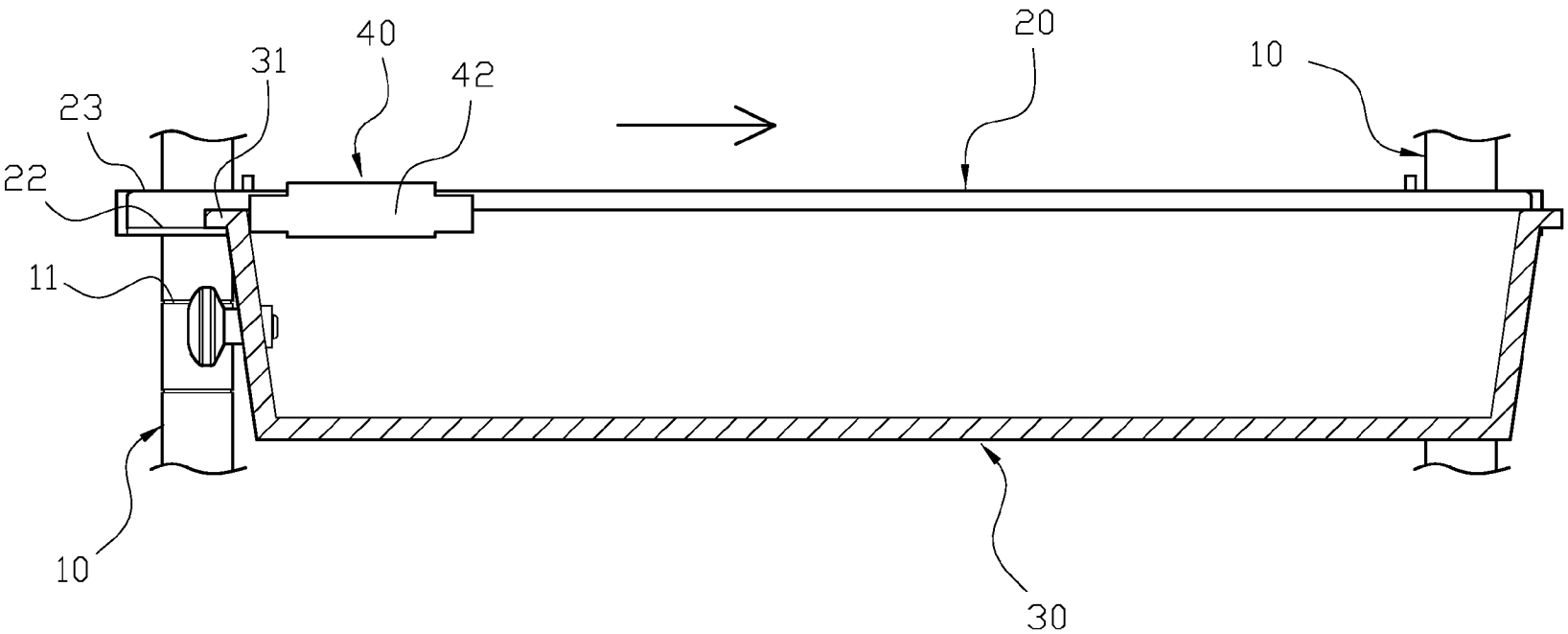
FIG. 6 is a first schematic view showing the operation of the drawer track structure of the present invention.
Figure 7:
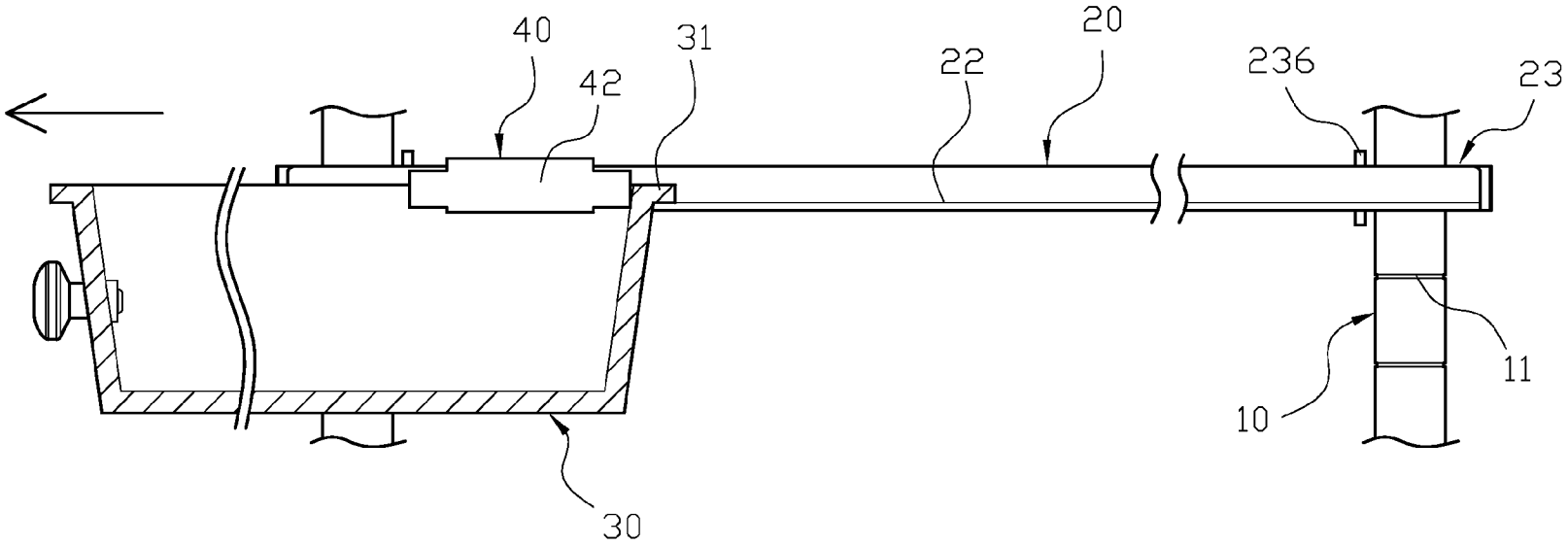
FIG. 7 is a second schematic view showing the operation of the drawer track structure of the present invention.

As illustrated in FIGS. 1, 2 and 3, a drawer track with an anti-slip structure may include four connecting units 10, two rails 20, a drawer 30, and at least one anti-slip member 40. At least one pair of rails are horizontally installed on both sides of a receiving space formed by said connecting units at four corners The rail 20 has a plurality of through holes 21 and a slide sheet 22 disposed an inner portion of the rail 20. The rails 20 has at least one fixing member 23 connected to one of its ends, which comprises a first block unit 231 and a second block unit 232, wherein the first block unit 231 is connected to the edge of the rail 20 and the second block unit 232 is connected to the first block unit 231. Each of the first block unit 231 and the second block unit 232 has a semicircular notch 233 corresponding to each other. The first block unit 231 and the second block unit 232 are connected with a flexible unit 234, which allows the second block unit 231 to flip over, and the first block unit 231 and the second block unit 232 engage with each other to enclose the connecting unit 10, and the connecting unit 10 has a plurality of ring groove 11. The first block unit 231 has a protruding wedge connector 235 located at one side of the rail 20, and the second block unit 232 has a round rod 236 distant from the first block unit 231, wherein the round rod 236 is engaged with the wedge connector 235 to achieve a secured connection. Furthermore, semicircular notch 233 of the first and the second block units 231/232 each has a semicircular protruding ring 237 bulged from the inner surface of the semicircular notches 233 to plug into the ring groove 11 of the connecting unit 10. A drawer 30 has two top frames 31 protruding from the top portion thereof, and the drawer 30 is placed onto and slides along the slide sheets 22 of the rails 20 with the top frames 31. Furthermore, at least one L-shaped anti-slip member 40 is installed to the rail 20, and the L-shaped anti-slip member 40 comprises a body unit 41 and a stopper plate 42, wherein the body unit 41 has a plurality of cylindrical bodies 43 to plug into the through holes 21 of the rail 20. The cylindrical body 43 has a conical head 431 and multiple axial slots 432, so the conical head 431 of the cylindrical body 43 is able to be inserted into the through hole 21 of the rail 20, and the conical head 431 is configured to prevent the cylindrical body 43 to detach from the through hole 21 of the rail 20. The body unit 41 extends to the drawer 30 and allows the stopper plate 42 of the anti-slip member 40 to contact the inner side of the top frame 31 of the drawer 30, thereby restricting the sliding movement of the drawer 30 within a certain range and preventing the drawer 30 to detach from the rail 20 due to deformation caused by storing heavy items. These structural characteristics of the novel drawer track structure dramatically increase its performance especially its structural stability in practical uses.

The installation process of the drawer track structure of the present invention is described as shown in FIGS. 1 to 5. The rail 20 is installed to the two upright connecting units 10 with the fixing member 23 located on both of its ends, by contacting the semicircular notch 233 of the first block unit 231 to the connecting unit 10 and placing the protruding semicircular ring 237 into the ring groove 11 located in the outer surface of the connecting unit 10. Then, by flipping the second block unit 232 over as the function of the flexible member 234, and allowing the semicircular notch 233 and the protruding semicircular ring 237 of the second block unit 232 to be properly placed, the first and second block units 231/232 contact to form a circular structure that encloses the connecting unit 10. The round rod 236 of the second block unit 232 is then engaged to the wedge connector 235 of the first block unit 232, thereby completing the installation process of the rail 20 to the connecting unit 10. The drawer 30 is then placed onto the slide sheet 22 of the two opposing rails 20 with the top frames 31 of the drawer 30, which also allows the drawer 30 to slide along the slide sheets 22 of the rail 20. The anti-slip member 40 is installed to the rail by interposing the cylindrical bodies 43 of the body unit 41 into the through holes 21 of the rail 20, which allows the positioning of the anti-slip member 40 to be secured by the conical head 431 that prevents the cylindrical body 43 to detach from the through hole 21. The body unit 41 of the slide stopped member 40 is then placed over the top frames 31 of the drawer 30 and the stopper plate 42 is placed against the inner wall of the drawer 30, thereby achieving the position restricting effect to the movement of the drawer 30. The installation process of the novel track structure of the present invention is thus simple and can be readily and conveniently performed, which is advantageous for practical uses.

Figure 8:
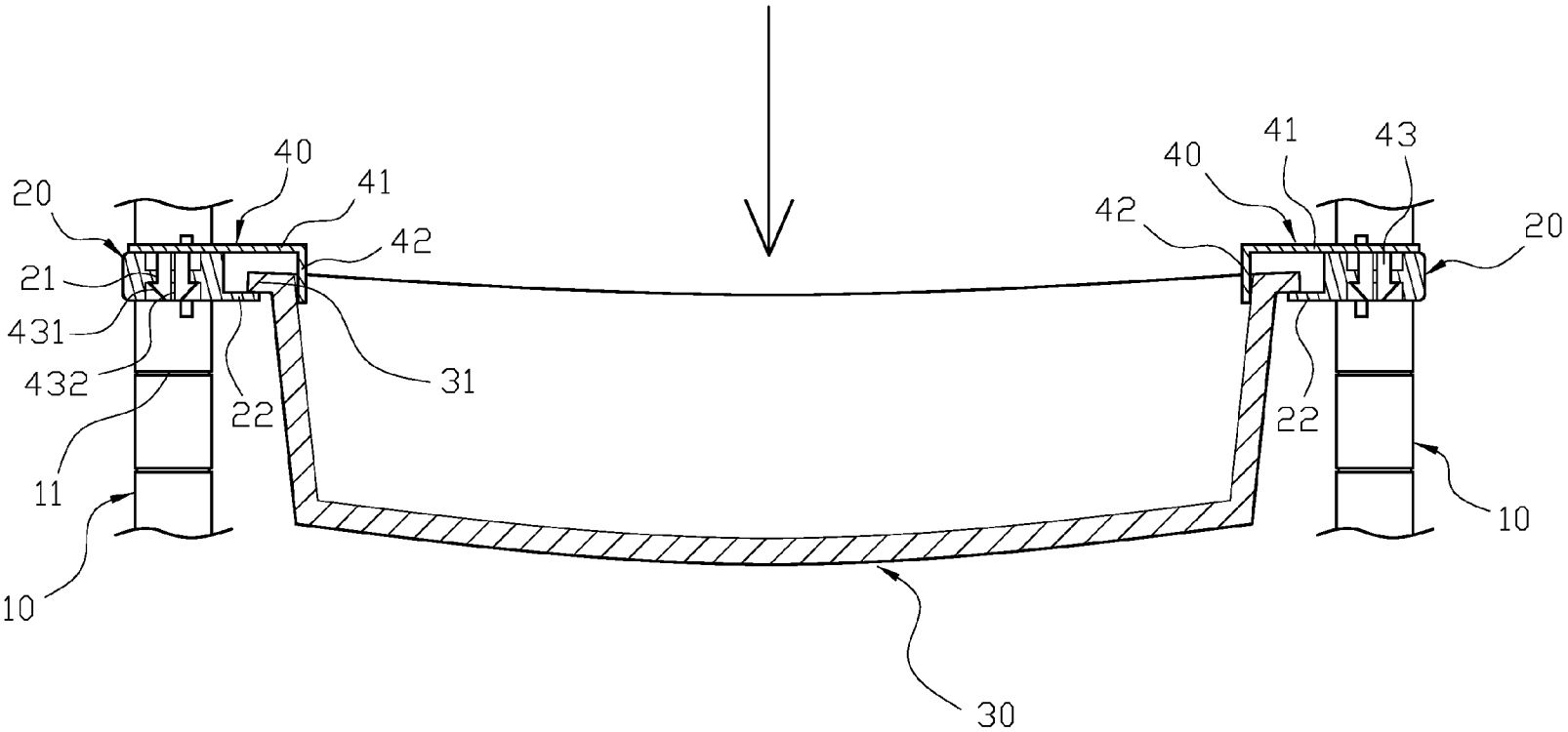
FIG. 8 is a third schematic view showing the operation of the drawer track structure of the present invention.

The advantages of the novel track structure in practical uses are further illustrated in FIG. 2 and FIGS. 5, 6 and 7. As the anti-slip member 40 is installed to the rail 20 with the cylindrical body 43 interposed into the through holes 21 of the rail 20, and the body unit 41 is extended towards the drawer 30 and the stopper plate 42 is placed against the inner wall of the drawer 30, therefore when the drawer 30 slides along the rail 20, the stopper plate 42 of the anti-slip member 40 limits the positions of the maximum opening and closing of the drawer 20, thereby preventing the drawer 20 to fall out from the drawer track structure as a result of excessive sliding movement. Another possible situation that is likely to occur in practical uses, as illustrated in FIG. 8, is that the middle portion of the drawer 30 may become deformed and bend downwardly when heavy units are placed into the drawer 30, which reduces the distance between the two top frames 31 of the drawer 30 and allows the drawer to fall out from the drawer track structure. The structural design of the novel drawer track structure of the present invention, by placing the stopper plate 42 of the anti-slip member 40 against the inner wall of the drawer 30, prevents the drawer 30 to detach from the slide sheets 22 of the rail 20 due to the deformation of the drawer 30, thereby increasing the stability of the drawer track structure in practical uses.

Figure 9:
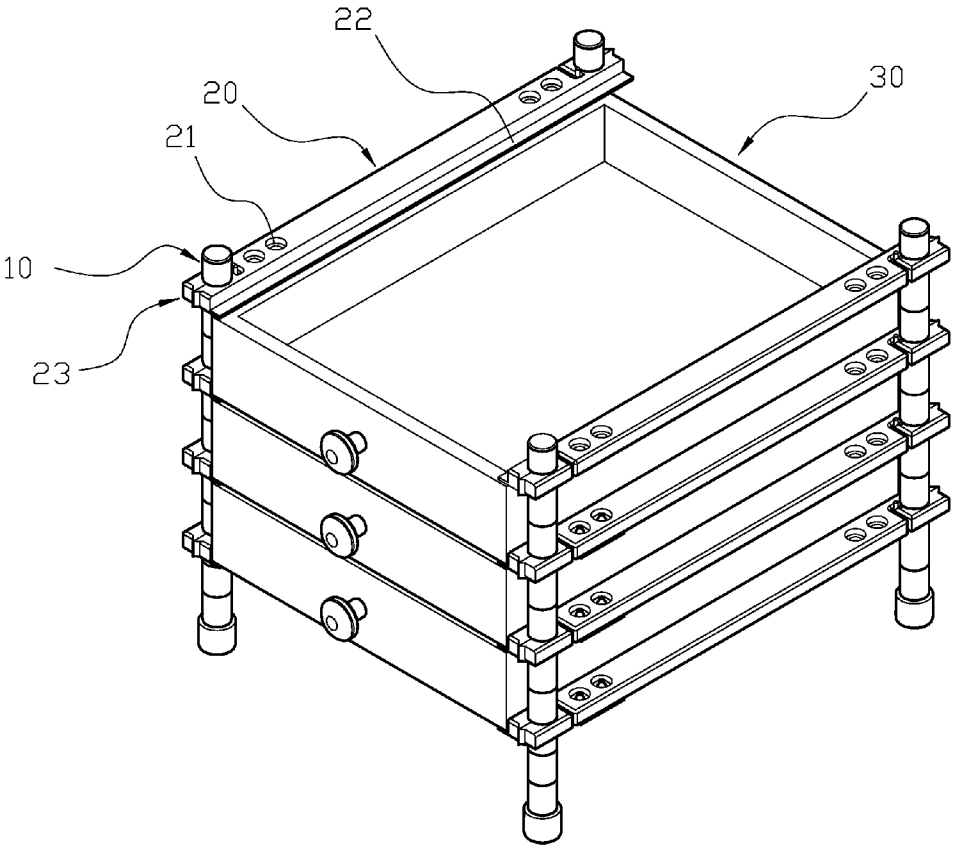
FIG. 9 is another specific embodiment of the drawer track structure of the present invention.
Figure 10:
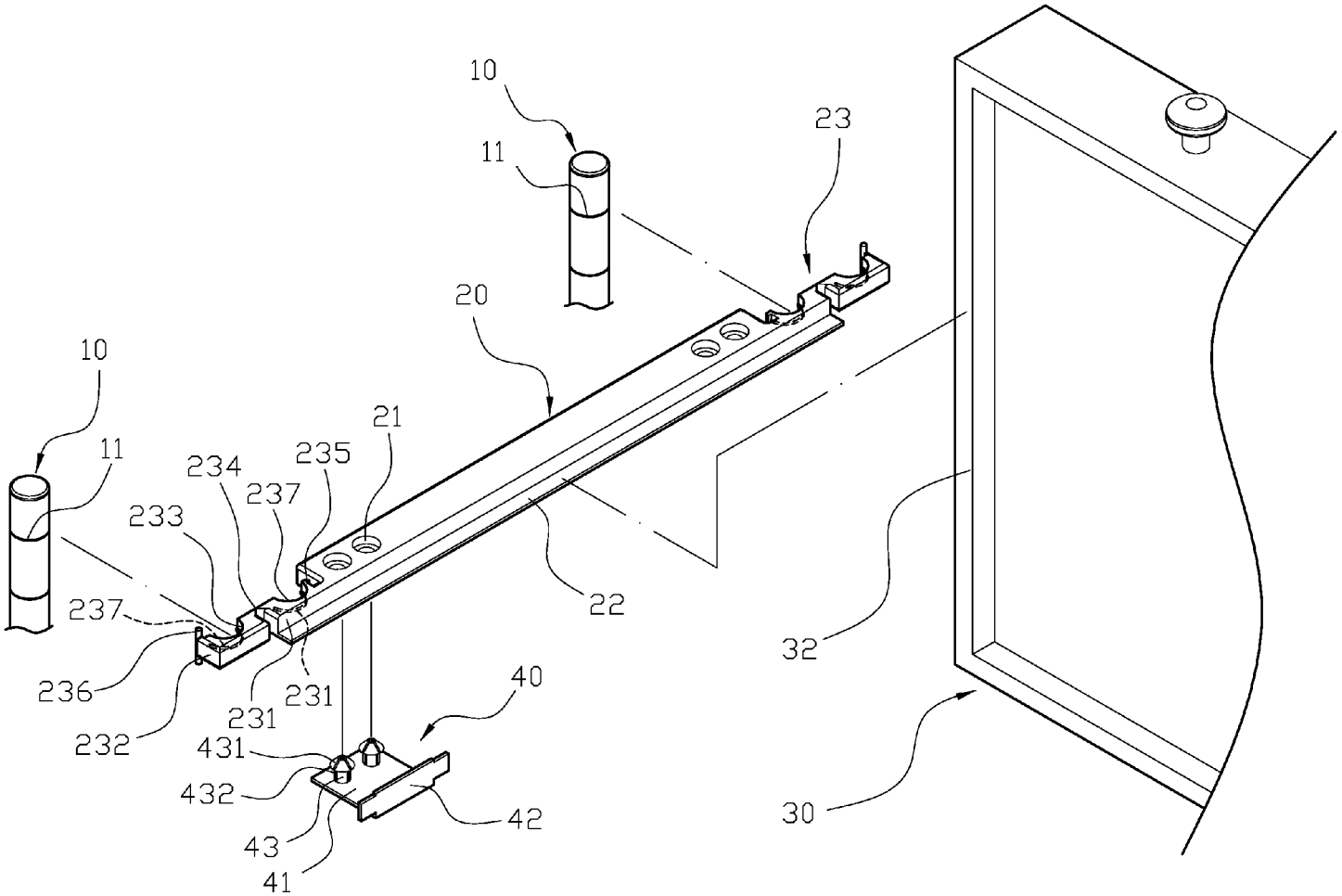
FIG. 10 is a exploded view of the another specific embodiment of the drawer track structure of the present invention.
Figure 12:
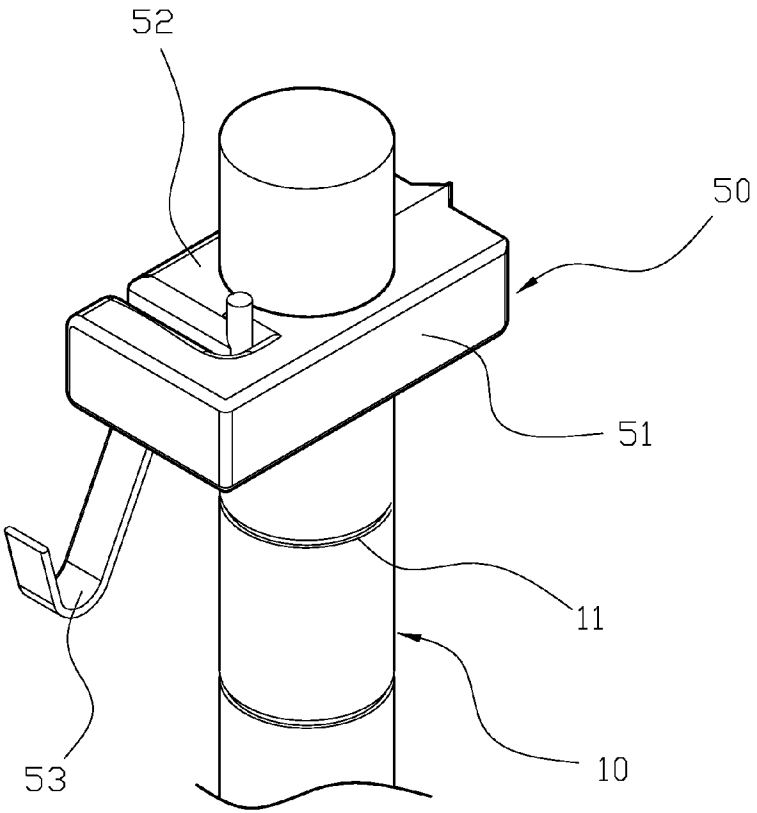
FIG. 12 is a second schematic view showing the operation of the another embodiment of the drawer track structure of the present invention.
Figure 11:
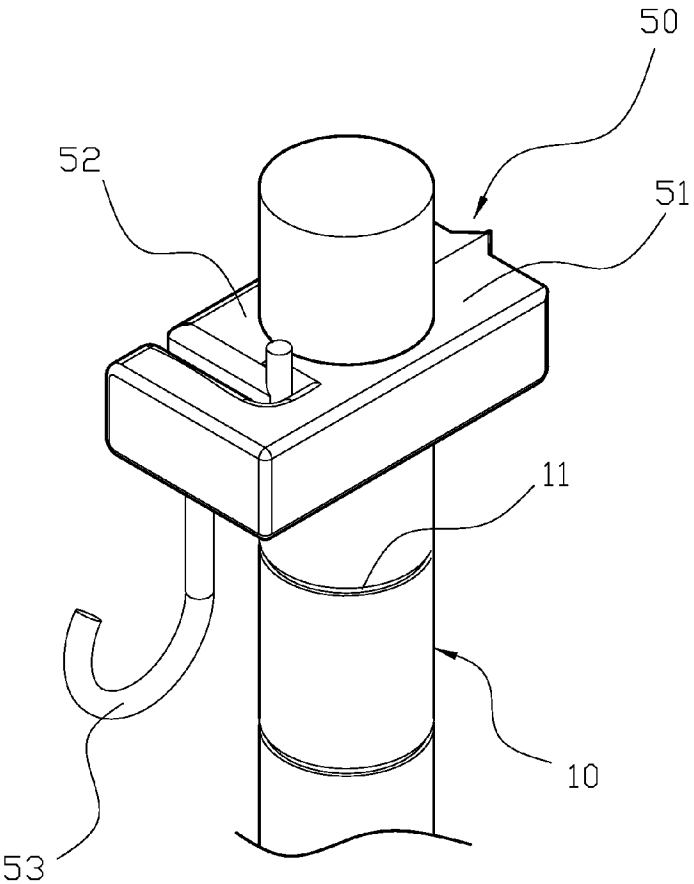
FIG. 11 is a first schematic view showing the operation of the another embodiment of the drawer track structure of the present invention.

Another embodiment of the novel track structure of the present invention is illustrated in FIGS. 9 and 10. In this embodiment, the drawer 30 has the bottom part of both its left and right edges extended downwardly to form two bottom frames 32, and the drawer 30 is placed onto the slide sheets 22 and slides along the rail 20 with these two bottom frames 32. In addition, the movement of the drawer 30 is also restricted by the stopper plate 42 of the anti-slip member 40 that is placed against the inner surface of the extended bottom frame 32 of the drawer 30, which limits the positions of the maximum opening and closing of the drawer 30. With a similar mechanism as previously described for the above-mentioned exemplary embodiment, the stopper plate 42 of the anti-slip member 40 also prevents the drawer 30 to detach from the drawer track structure due to deformation caused by storing heavy items, thereby achieving the equivalent position securing effect. Furthermore, as illustrated in FIGS. 11 and 12, the connecting unit 10 of the drawer track structure of the present invention may be connected with a conjugating member 50, which comprises a main conjugating unit 51 and an axillary conjugating unit 52 that is attached to one side of the main conjugating unit 51. The main conjugating unit 51 and the axillary conjugating unit 52 are located on the opposite sides of the connecting unit 10, enclose the connecting unit 10 when installed, and are connected to the connecting unit 10. The main conjugating unit 51 of the connecting member 50 is connected with a hook 53*a* (53*b*), which allows articles to be hanged, thereby increasing the possible uses of the drawer track structure of the present invention.

To summarize, the present invention describes a novel improved drawer track structure with a breakthrough in structural design, further improved new components, and advantages in commercial exploration. The present invention has not been disclosed in any published materials and thus possesses novelty.

The above description and illustrations are for one or more exemplary embodiments of the present invention and should not be considered to limit the scope of the implementation of the present invention. Accordingly, the present invention is not to be considered as limited by the forgoing description, but includes any equivalents.

What is claimed is:

1. A drawer track with an anti-slip structure comprising:

four connecting units;

two rails horizontally installed on both sides of a receiving space formed by said connecting units at four corners, said rail having multiple through holes and a slide sheet on each inner portion of the rails;

a drawer, which is disposed on and slid along the slide sheets of the rails; and at least one anti-slip member, wherein said anti-slip member is L-shaped and has a body unit and a stopper piece, and the body unit has a plurality of cylindrical bodies, and the anti-slip member is connected to said rail with the cylindrical bodies, so the body unit is configured to extend towards the drawer, and the stopper plate is used to stop the drawer and restrict the drawer's movement to prevent the drawer from escaping from the rails when the drawer is overweight, wherein the rail has a fixing member on at least one end, said fixing member having a first block unit and a second block unit, said first block unit secured to one end of the rail and said second block unit pivotally connected to the first block unit; each of the first block unit and the second block unit having a semicircular notch, and the first block unit and the second block unit enclosing each of the connecting units.

2. The drawer track with an anti-slip structure of the claim 1, wherein the first block unit and the second block unit of the fixing member are connected with a flexible unit, which causes the second block unit to flip.

3. The drawer track with an anti-slip structure of the claim 1, wherein outer surface of each of the connecting units has multiple ring grooves, and each of the semicircular notches of the first and second block units forms a protruding semicircular ring to plug into the ring groove of each of the connecting units to engage with each other.

4. The drawer track with an anti-slip structure of the claim 1, wherein the first block unit has a wedge connector at a rail end thereof, and the second block unit has a round rod away from the first block unit, and the first block connects with the second block through the engagement of the wedge connector and the round rod.

5. The drawer track with an anti-slip structure of the claim 1, wherein a rear end of the cylindrical body of the anti-slip member has a conical head, and the cylindrical body has multiple axial slots, so the conical head of the cylindrical body is able to be inserted into the through hole of the rail, and the conical head is configured to prevent the cylindrical body to detach from the through hole of the rail.

6. The drawer track with an anti-slip structure of the claim 1, wherein the drawer has a protruding bottom frame at edges of the bottom of the drawer, and the drawer is placed onto the slide sheets and slides along the rail with the protruding bottom frame, and the stopper plate of the anti-slip member is placed against an inner portion of the protruding bottom frame.

7. The drawer track with an anti-slip structure of the claim 1, wherein top edges of the drawer have a protruding side frame, the drawer is placed onto and slide along the slide sheets of the rail with said side frame, and the stopper plate of the anti-slip member is placed against an inner portion of said side frame.

8. The drawer track with an anti-slip structure of the claim 1, wherein each of the connecting units has at least one conjugating member, said conjugating member having a main conjugating unit and an axillary conjugating unit connected to the main conjugating unit to enclose and secure each of the connecting units.

9. The drawer track with an anti-slip structure of the claim 8, wherein said main conjugating unit has a hook to hang articles.

* * * * *